United States Patent [19]

Wethington

[11] 3,941,645

[45] Mar. 2, 1976

[54] CARPET MACHINE

[75] Inventor: Charles A. Wethington, Spartanburg, S.C.

[73] Assignee: Deering Milliken Research Corporation, Spartanburg, S.C.

[22] Filed: July 2, 1974

[21] Appl. No.: 485,119

Related U.S. Application Data

[63] Continuation of Ser. No. 403,744, Oct. 5, 1973, abandoned, which is a continuation of Ser. No. 252,974, May 15, 1972, abandoned.

[52] U.S. Cl. ..... 156/435; 156/462

[51] Int. Cl.[2] ..... B32B 5/00; D05C 15/00

[58] Field of Search ..... 156/72, 162, 173, 177, 156/179, 189, 204, 205, 210, 272, 429, 430, 431, 435, 443, 446, 459, 462, 468, 472, 473, 474, 475, 477, 489, 490, 491; 28/1.8, 72 P

[56] References Cited

UNITED STATES PATENTS

| | | | |
|---|---|---|---|
| 2,101,906 | 12/1937 | Hopkinson | 156/435 |
| 2,116,048 | 5/1938 | Smith | 156/178 |
| 2,583,337 | 1/1952 | Laing | 156/471 |
| 2,638,959 | 5/1953 | Johnson | 156/435 |
| 2,831,525 | 4/1958 | Cole | 156/435 |
| 3,132,985 | 5/1964 | Moore | 156/462 |
| 3,701,700 | 10/1972 | Von Der Heide | 161/66 |

FOREIGN PATENTS OR APPLICATIONS

| | | | |
|---|---|---|---|
| 1,560,873 | 1969 | Germany | 156/435 |

*Primary Examiner*—Douglas J. Drummond
*Assistant Examiner*—John E. Kittle
*Attorney, Agent, or Firm*—Earle R. Marden; H. William Petry

[57] ABSTRACT

Method and apparatus to produce a bonded loop pile carpet. The carpet machine is of the rotary type which uses cooperating blade members to form the yarn loops for bonding to a backing sheet. One set of the blade members is reciprocably mounted in the rotor of the machine.

2 Claims, 8 Drawing Figures

CARPET MACHINE

This is a continuation of application Ser. No. 403,744 which in turn is a continuation of application Ser. No. 252,974, filed May 15, 1972, both abandoned.

It is an object of this invention to provide a method and apparatus to efficiently, inexpensively and continuously produce a bonded loop pile carpet.

Other objects and advantages of the invention will become readily apparent as the specification proceeds to describe the invention with reference to the accompanying drawings, in which.

Figure 1:
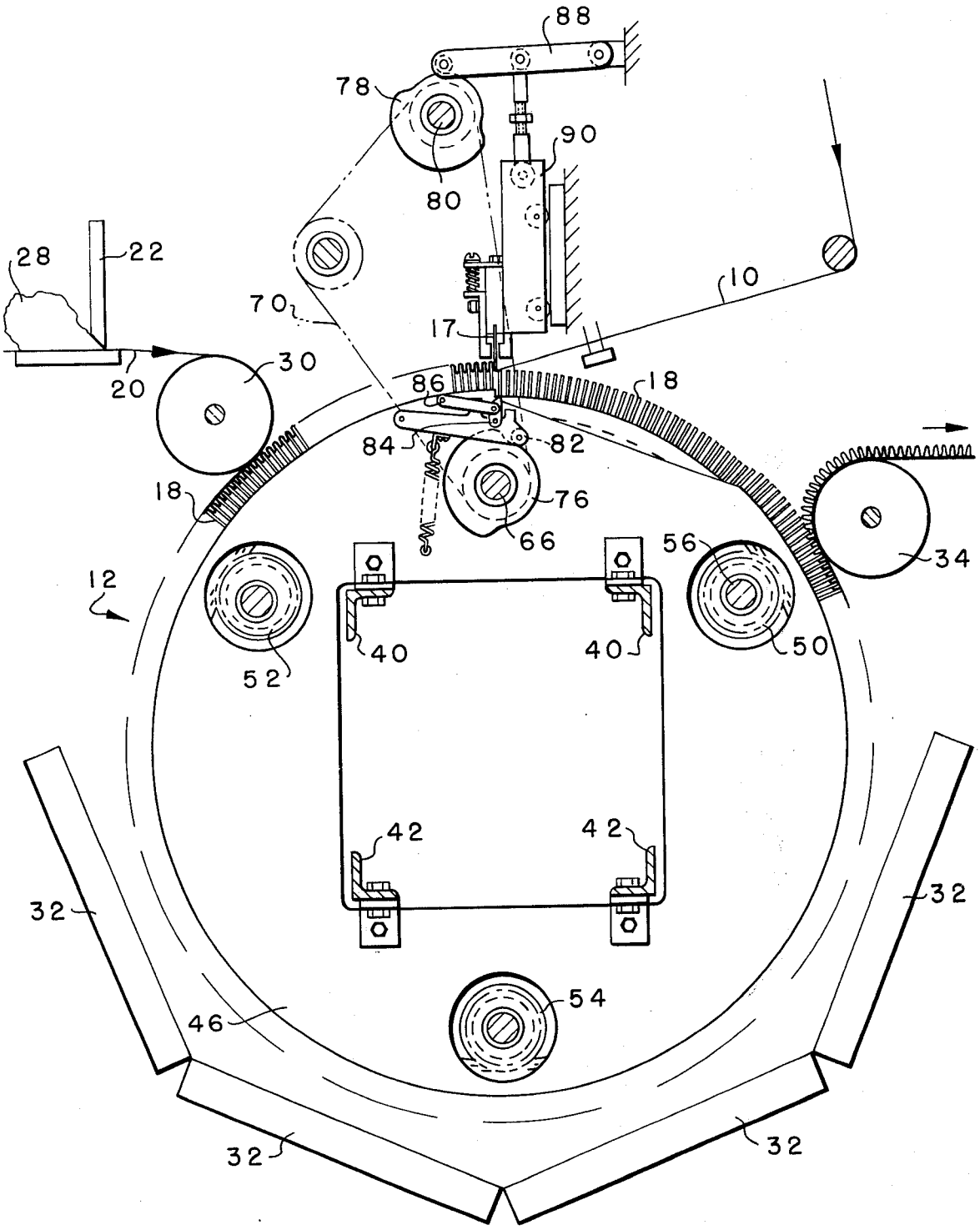
FIG. 1 is a sectional elevation view taken on line 1—1 of FIG. 2.
Figure 2:
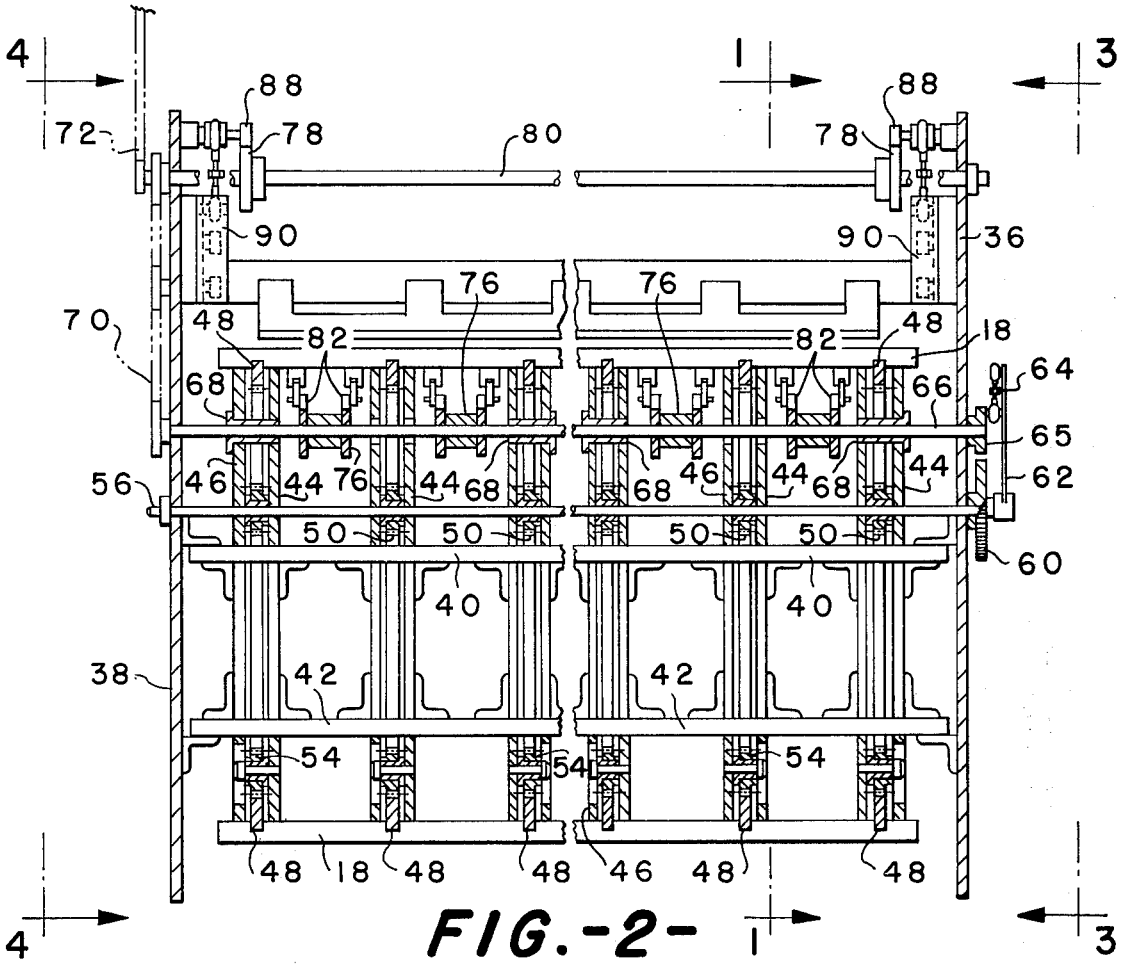
FIG. 2 is a cross-sectional elevation view of the carpet machine rotor.
Figure 8:
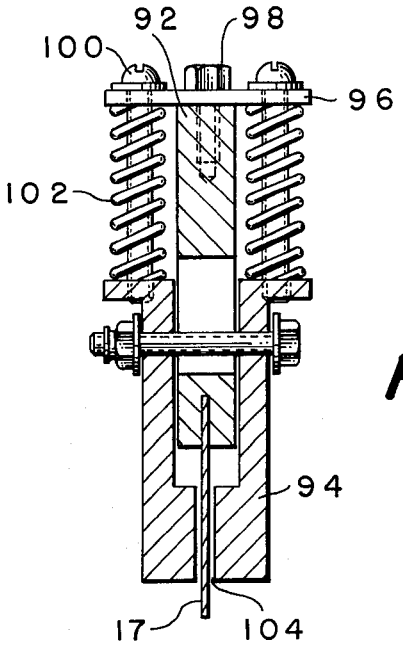
FIG. 8 is a blown-up view of the pressure foot shown in FIG. 6.
Figure 3:
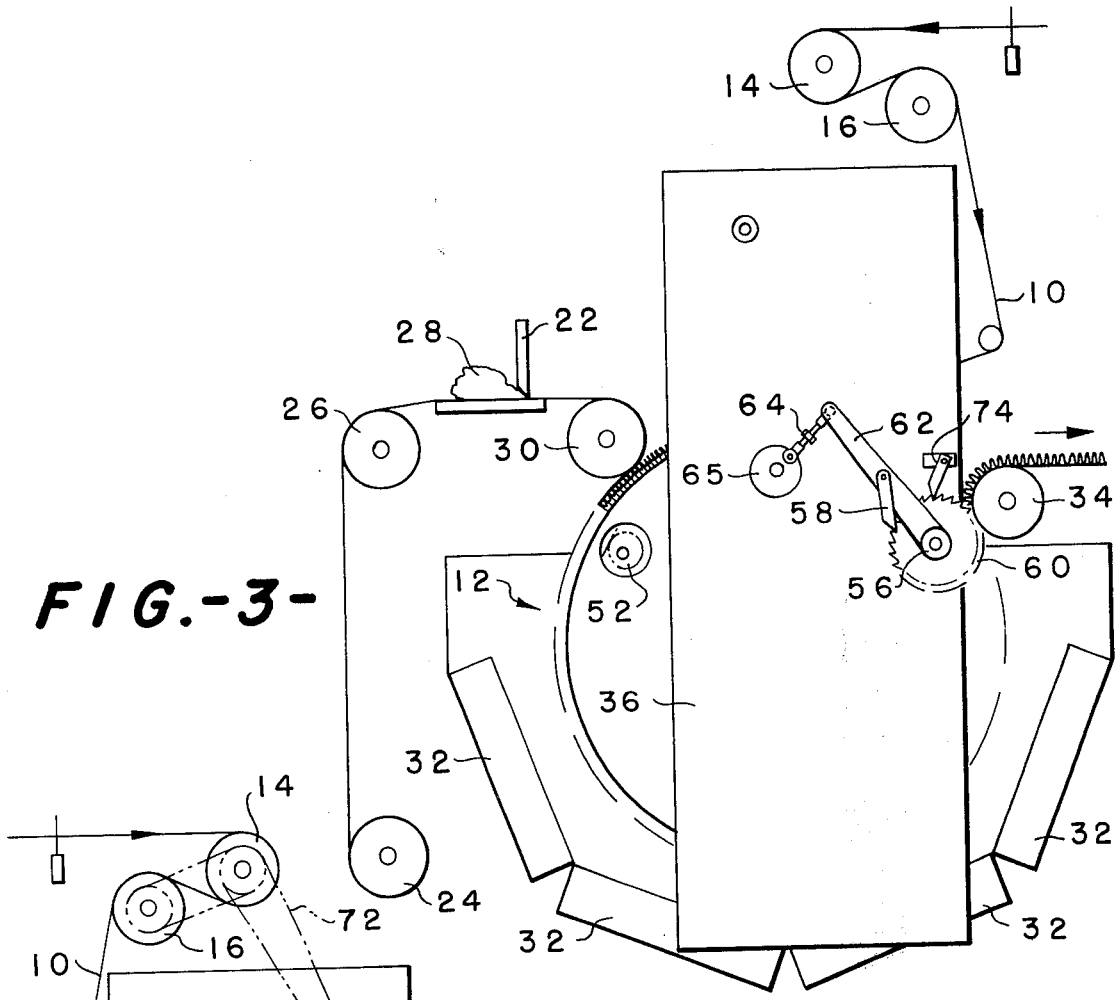
FIG. 3 is an elevation view taken on line 3—3 of FIG. 2.
Figure 4:
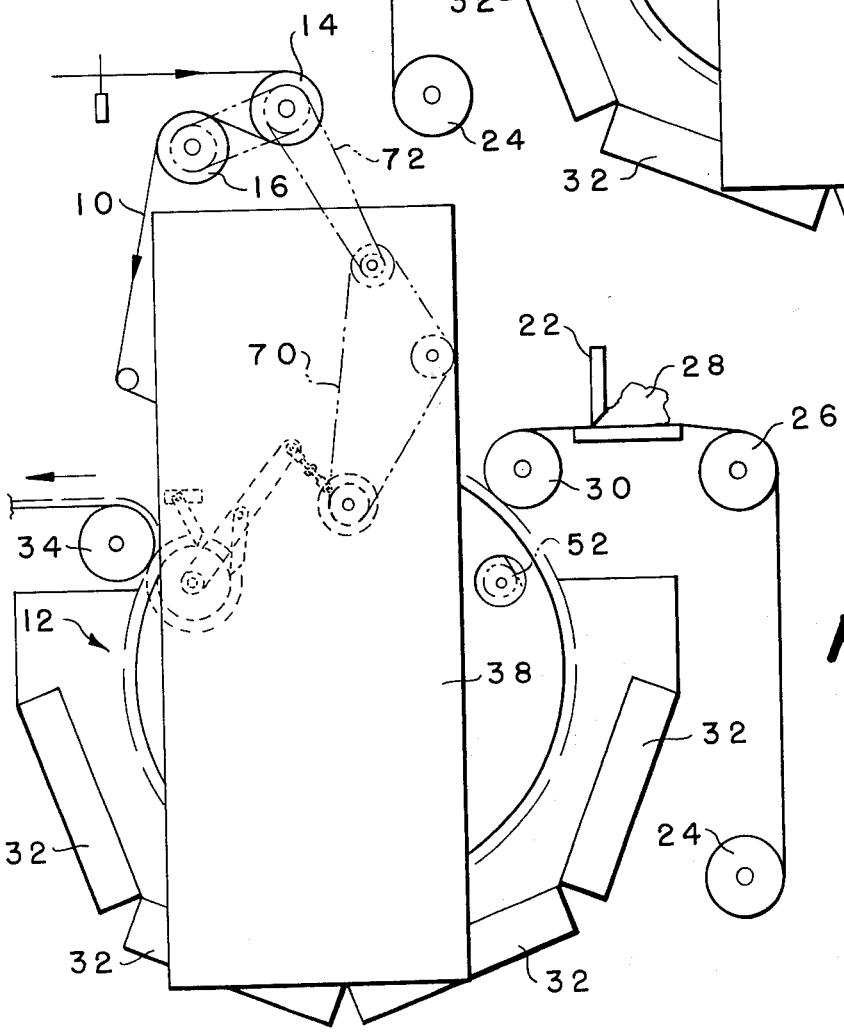
FIG. 4 is an elevation view taken on line 4—4 of FIG. 2.

Looking at FIGS. 1, 3 and 4, the overall concept will be explained. A plurality of yarn ends 10 are supplied from a warp beam or creel (not shown) to the rotor 12 over a pair of rolls 14 and 16. At the rotor, upper blade 17 cooperates with the lower blades 18 to insert the yarn in loops between the lower blades 18. The rotor is rotated counterclockwise and the loops are inserted into a suitable adhesive, such as polyvinyl chloride, placed on a backing sheet 20 by the doctor blade 22. The backing sheet is supplied from a roll 24, over a roll 26 to the adhesive station 28 and then over pressure roll 30 to a position against the top of loops. The backing sheet with the loops thereattached continues to rotate counter-clockwise past the infrared electric heaters 32 to set the bond between the loops and the backing sheet. The bonded carpet is then doffed over roll 34 and delivered to the take-up roll (not shown).

The rotor 12 is supported between side plates 36 and 38 by cross-supports 40 and 42 to which are attached a plurality of support plates 44 and 46. Rotably suppoted between the plates 44 and 46 are blade support rings 48 which are held in position by drive gear 50 and idler gears 52 and 54 which are mounted on one of the plates 44 and 46 and engage the toothed inner surface of the rings 48. Each of the blade support rings 48 has a plurality of notches cut in the outer surface thereof to slidably support the lower blades 18. The lower blades are held in the notches by suitable means such as springs (not shown).

The driven gears 50 are rigidly secured to a rotably mounted shaft 56 which is intermittently rotated by the action of the pawl 58 against the ratchet 60 mounted on one end of shaft 56. The pawl 58 is pivotally mounted and actuated by the crank arm 62 which is rotated by the lever 64 connected to the crank 65. Crank 65 is mounted on shaft 66 supported by bearings 68 in the plates 44 and 46 and is driven by chain 70 which is driven from a drive source (not shown) by chain 72. A second pawl 74 is pivotally mounted adjacent the ratchet 60 to prevent back lash of the ratchet.

Also mounted on the shaft 66 between adjacent pairs of plates 44, 46 are cams 76 to periodically actuate the blades 18. Another set of cams 78 is mounted on shaft 80 which is also driven by chain 70 in timed relation so that the cams 76 and 78 rotate in a one-to-one ratio.

Each of the cams 76 have a pair of spring loaded followers 82 operably associated therewith to slide upwardly one of the lower blades 18 at a predetermined time. The follower causes the pivotally mounted arm 84 to move upwardly to engage the blade 18. Another lever 86 is pivotally connected to cause the arm 84 to move in a substantially perpendicular direction to raise the blade 18 straight up.

Cams 78 are operably associated with a follower arm 88 pivotally connected to the frame of the machine to raise and lower the upper blade holder 90. Mounted to the blade holder 90 is the upper blade support 92 and the presser foot 94. The blade support 92 is secured to the movable plate 96 by means of bolt 98. Bolts 100 project through plate 96 to support the pressure foot 94. Located between the plate 96 and the presser foot 94 around the bolts 100 are compression springs 102 for reasons hereinafter explained. The upper blade 17 is mounted on the end of blade support 92 and projects through the elongated opening 104 in the presser foot.

In the preferred embodiment the rotor 12 is stopped when the blades 17 and 18 are forming the loops and then the rotor is indexed to the next loop forming position but such motion is not mandatory. It is contemplated that the motion of the rotor could be continuous and the blade holder 90 could move therewith in a manner as shown in U.S. Pat. No. 3,385,747 wherein the motion of the top blade is synchronized with the motion of a rotor by having the angular velocity of the blade holder equal to the angular velocity of the rotor during a portion of the loop forming period.

Figure 6:
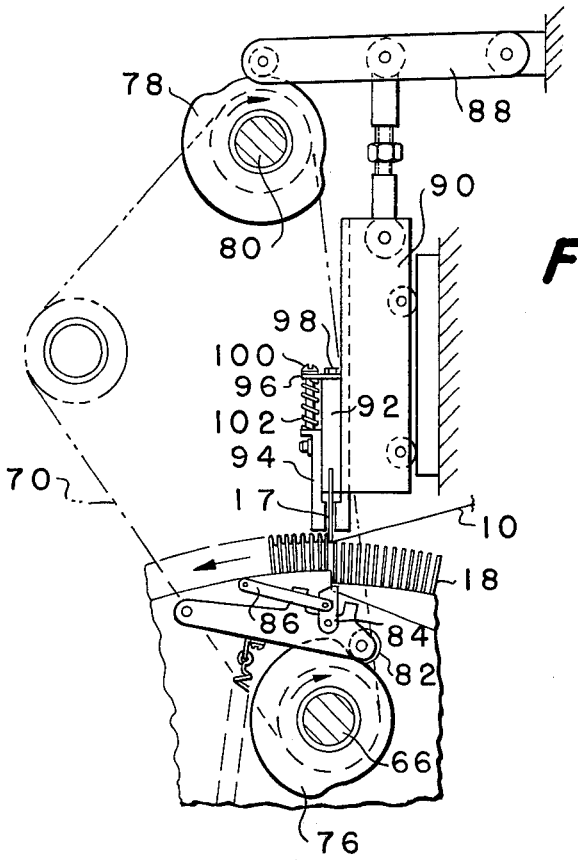
FIGS. 5–7 are blown-up views of the loop forming mechanism showing various stages of loop formation.
Figure 7:
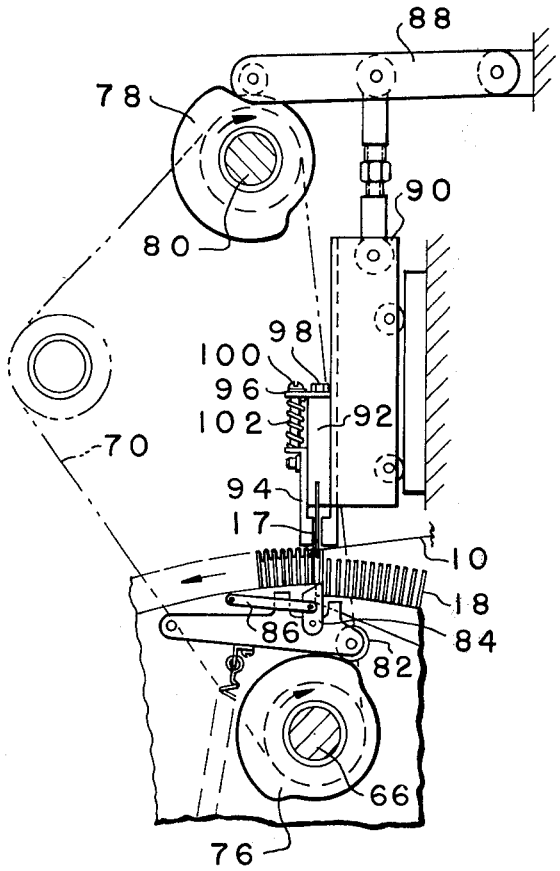
Figure 5:
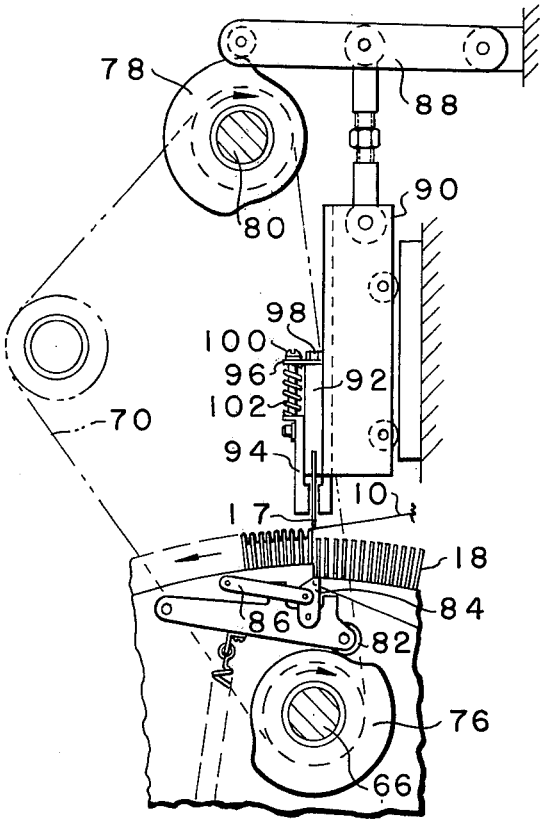

Looking now to FIGS. 5–7 the loop forming operation will be explained. In FIG. 5 the ratchet 58 and pawl 60 have been actuated to rotate the blade 18 to the position indicated. The cam 78 has pivoted the lever 88 to the extreme upward position to hold the blade 17 in its up position. Then as the cams 76 and 78 continue to rotate they assume the position shown in FIG. 6 wherein the upper blade 17 is lowered to bend the yarn downward over one of the blades 18 while the presser foot 94 engages the top of the previously formed yarn loop to prevent it from being pulled out as the blade 17 folds the yarn over the blade 18. Then as the cams 76 and 78 continue to rotate they assume the position shown in FIG. 7 wherein the blade 17 remains in the downward position while the arm 84 is moved upward by the cam 76 to slide the blade 18 upward to form the other half of the yarn loop between adjacent blades 18. Once the yarn loop is formed between adjacent blades 18 the cams 76 and 78, respectively, allow the blade 18 to retract and move the blade 17 upwardly. It should be noted (FIG. 1) that the blades 18 do not retract until they are indexed or rotated beyond the beginning of the chord section of the support plate 46 located in the direction of rotation beyond the roll 34. The blades 18 are once again indexed to the position shown in FIG. 5 and the cycle is repeated.

It should be noted that only half the yarn loop is being formed at any one time, thereby reducing the frictional forces on the yarn between the blade 18 and the yarn. This results, necessarily, in a reduction in the amount of force necessary by the blades 17 and 18 to form the yarn loops.

Although I have described specifically the preferred embodiment of my invention I contemplate that changes may be made without departing from the scope or spirit of my invention and I desire to be limited only by the claims.

That which is claimed is:

1. Apparatus to produce a bonded pile fabric comprising: a rotor, means to rotate said rotor, means slidably mounting a plurality of blades in said rotor, a second single blade member reciprocably mounted above said plurality of blades and operably associated therewith, means to supply yarn between said plurality of blades and said second blade member, means to move said second blade member downwardly at a predetermined time to bend the yarn over one blade of said plurality of blades, means to slide upwardly the blade of said plurality of blades next adjacent to the blade over which the yarn is bent to form a loop in said yarn, means to move said single blade member upwardly away from the formed loop, means to index said rotor to rotate said rotor a predetermined distance to place the blade members in loop forming position, means to supply an adhesive backed backing material into contact with said formed loop, means to set the bond between said adhesive and said loop and means to guide said backing material with loops bonded thereto away from said apparatus, said rotor including a means to maintain said blades of said plurality of blades in said loops until said rotor is indexed to a point where a formed loop is guided away from said apparatus and a means to allow said plurality of blades to slide downwardly after the formed loop is guided away from said apparatus, said means slidably mounting said plurality of blades including a notched ring and a support ring, said means to allow said plurality of blades to slide downwardly including a section cut out of said support ring.

2. The structure of claim 1 wherein the section cut out of said support ring is a chord section.

* * * * *